US011045862B2

(12) United States Patent
Henault et al.

(10) Patent No.: US 11,045,862 B2
(45) Date of Patent: Jun. 29, 2021

(54) STAKING TOOL AND METHOD OF USING THE SAME

(71) Applicant: Honda Motor Co., Ltd., Tokyo (JP)

(72) Inventors: Jeffery Charles Henault, Marysville, OH (US); Richard Allen France, Ostrander, OH (US)

(73) Assignee: Honda Motor Co., Ltd., Tokyo (JP)

( * ) Notice: Subject to any disclaimer, the term of this patent is extended or adjusted under 35 U.S.C. 154(b) by 65 days.

(21) Appl. No.: 16/293,758

(22) Filed: Mar. 6, 2019

(65) Prior Publication Data

US 2020/0282450 A1 Sep. 10, 2020

(51) Int. Cl.
*B21J 15/38* (2006.01)
*B25D 1/00* (2006.01)

(52) U.S. Cl.
CPC ..... *B21J 15/383* (2013.01); *B25D 1/00* (2013.01)

(58) Field of Classification Search
CPC .... B21J 15/383; B25D 1/00; B25D 2250/231; B25D 2250/295; B25D 3/00; B29C 66/00
See application file for complete search history.

(56) References Cited

U.S. PATENT DOCUMENTS

| | | | |
|---|---|---|---|
| 3,356,121 | A | 12/1967 | Tabor |
| 5,029,498 | A | 7/1991 | Kinsey |
| 5,458,030 | A | 10/1995 | Betts |
| 6,116,125 | A | 9/2000 | McLeod |
| 9,259,824 | B2 | 2/2016 | Wu |
| 9,314,909 | B2 | 4/2016 | Vaamonde Coton et al. |
| 2013/0118324 | A1 | 5/2013 | Gowin, Jr. |

FOREIGN PATENT DOCUMENTS

| | | | |
|---|---|---|---|
| FR | 1495379 | A | 9/1967 |
| GB | 2350078 | A | 5/1999 |

*Primary Examiner* — John C Hong
(74) *Attorney, Agent, or Firm* — American Honda Motor Co., Inc.; Morgan Lincoln

(57) ABSTRACT

A staking tool is provided that is coupled to an axle of a vehicle and that includes a collar and a striker. The collar includes a guide notch defined on an interior surface. The striker includes a shaft and a handle. The shaft includes an angled tip at a first end of the striker and the handle includes a striking surface at a second end of the striker. The shaft is configured to slide longitudinally within the guide notch. A method for staking a spindle nut is also provided that includes positioning a collar over the spindle nut fastened on an axle of a vehicle, aligning a guide notch on the collar with a staking notch on the axle, inserting a striker into the guide notch, and striking the striker with a hammer.

13 Claims, 9 Drawing Sheets

STAKING TOOL AND METHOD OF USING THE SAME

BACKGROUND

Vehicles often include an axle onto which a spindle nut is tightened to secure a wheel hub onto the axle. The spindle nut typically screws onto an end of the axle and is tightened against the hub. In order to prevent the spindle nut from becoming unscrewed, the spindle nut may be staked.

Staking the spindle nut typically involves indenting a portion of the spindle nut into a cavity on an outside surface of the axle. Automated spindle staking machines are known that provide consistent and repeatable spindle nut staking. For known manual techniques, the stake may be completed by striking, with a mallet or hammer, a screwdriver, chisel, or other tool that is positioned perpendicular to the spindle nut and adjacent the cavity on the axle. However, this technique lacks a mechanism to ensure consistent application of the staking process. Too much striking force or a sharp profile on an angled tip of the tool may result in cracking or excessive deformation of the spindle nut. Conversely, too little striking force may result in an inadequate stake, allowing potential for the spindle nut to rotate. As such, there is need for a consistent and repeatable tool and method for staking a spindle nut onto an axle of a vehicle.

BRIEF SUMMARY

According to one aspect, a staking tool is provided that is coupled to an axle of a vehicle. The staking tool includes a collar and a striker. The collar includes a guide notch defined on an interior surface. The striker includes a shaft, an angled tip at a first end, and a handle at a second end. The striker is configured to slide longitudinally within the guide notch and stake a lip portion of the spindle nut into a staking notch of the axle.

According to another aspect, a system for securing a hub onto a vehicle is provided. The system includes an axle, a spindle nut, a staking tool, and a hammer. The axle includes a staking notch defined on an outer surface. The spindle nut includes a lip portion and a hex portion. The staking tool includes a collar and a striker. The collar includes a guide notch defined on an interior surface. The striker includes a handle, a shaft, and an angled tip.

According to another aspect, a method for staking a spindle nut is provided. The method includes positioning a collar over the spindle nut fastened on an axle of a vehicle, aligning a guide notch on the collar with a staking notch on the axle, inserting a striker into the guide notch, and striking the striker with a hammer.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

With reference now to the figures wherein the illustrations are for purposes of illustrating one or more exemplary embodiments and not for purposes of limiting the same, there is shown a staking tool.

Figure 1:
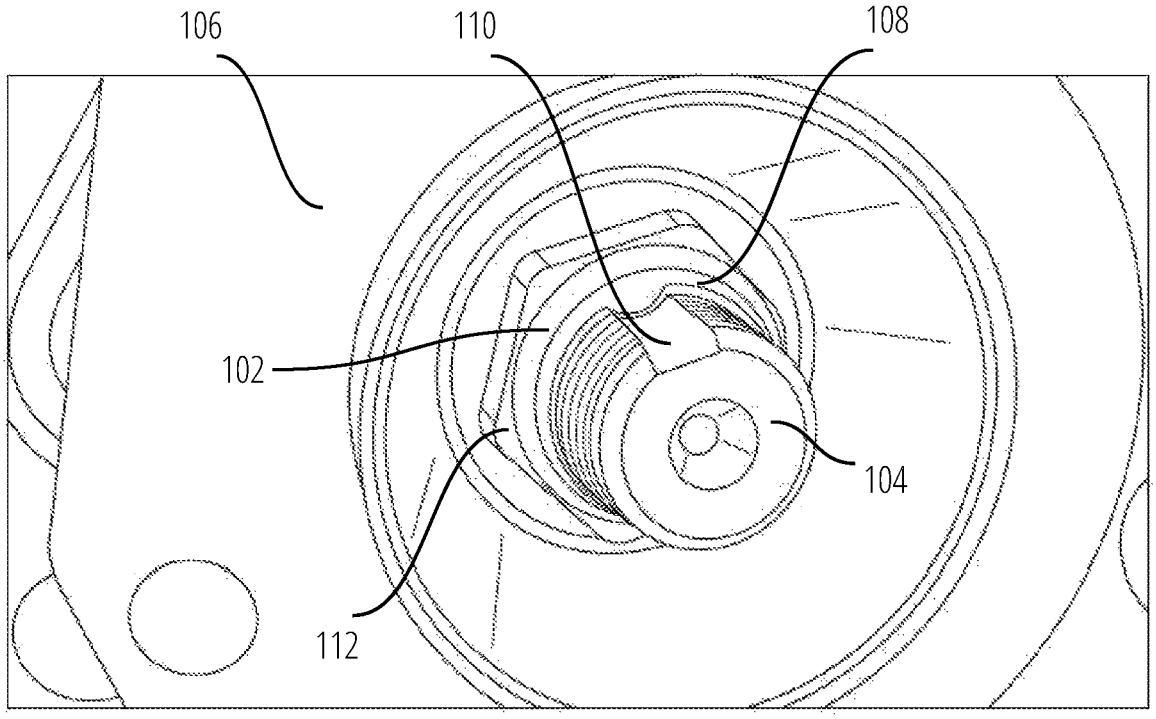
FIG. 1 is a perspective view of an exemplary embodiment of a spindle nut installed on an axle.

FIG. 1 is a perspective view of an exemplary embodiment of a spindle nut 102 installed on an axle 104 of a vehicle. The spindle nut 102 is screwed onto the axle 104 and tightened to a desired torque value against a vehicle component 106 such as a wheel hub assembly, for example. Due to high forces on the axle 104 and spindle nut 102, the spindle nut 102 is often secured to the axle 104 in some manner to prevent rotation away from the vehicle component. One method of securing the spindle nut 102 to the axle 104 is by staking the spindle nut 102, which involves indenting a lip portion 108 of the spindle nut 102 into a cavity defined in the axle 104 to physically prevent the spindle nut 102 from rotating. The cavity in the axle 104 is referred to as a staking notch 110 hereinafter. The spindle nut 102 also includes a hex portion for use in rotating the spindle nut 102 on the axle 104 using a wrench or socket.

Figure 2:
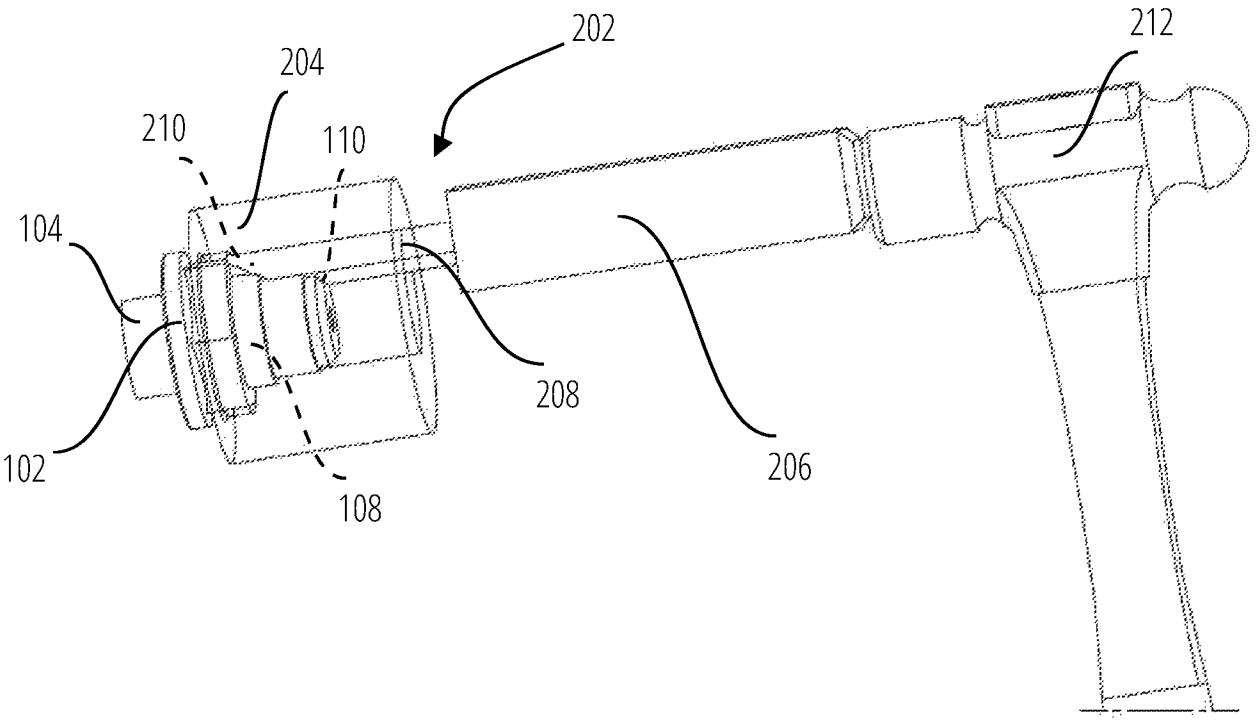
FIG. 2 is a first perspective view of an exemplary embodiment of a staking tool positioned on the spindle nut and axle shown in FIG. 1.

FIG. 2 is a first perspective view of an exemplary embodiment of a staking tool 202 positioned on the spindle nut 102 and axle 104 shown in FIG. 1. The staking tool 202 is used to stake the spindle nut 102 in the staking notch 110 of the axle 104 and prevent rotation of the spindle nut 102 away from the vehicle component 106. The staking tool 202 provided in the depicted embodiment includes a collar 204 and a striker 206. The collar 204 is positioned over the spindle nut 102 such that a guide notch 208 of the collar 204 is aligned with the staking notch 110. The striker 206 is configured to slide longitudinally (i.e., substantially parallel to the axle 104) within the guide notch 208 wherein an angled tip 210 of the striker is configured to contact the lip portion 108 of the spindle nut 102. A hammer 212 or mallet is used to impact the striker 206 to cause the striker 206 to partially indent, or stake, the lip portion 108 into the staking notch 110. More specifically, as the striker 206 is inserted into the guide notch 208, a distance of an inner surface of the angled tip 210 from a center of the axle 104 is reduced, causing the lip portion 108 to indent into the staking notch 110.

The collar 204 may be radially aligned with the spindle nut 102 at either the lip portion 108 or the hex portion 112. More specifically, the collar 204 may include a circular recess 404 defined therein, which will be described further with respect to FIG. 4, into which the hex portion 112 may be disposed in order to radially align the collar 204 with respect to the spindle nut 102 and axle 104. Alternatively, the collar 204 includes a cylindrical aperture 302, which will be described further with respect to FIG. 3, into which the lip portion 108 may be inserted to radially align the collar 204 with the spindle nut 102. For alignment purposes, the recess 404 or interior surface 402 may have a diameter that is slightly larger than a diameter of the hex portion 112 or lip portion 108, respectively. Radially aligning the collar 204 with respect to the spindle nut 102 maintains a constant distance between the shaft 308 of the striker 206, when inserted into the guide notch 208, and the center of the axle 104.

Figure 3:
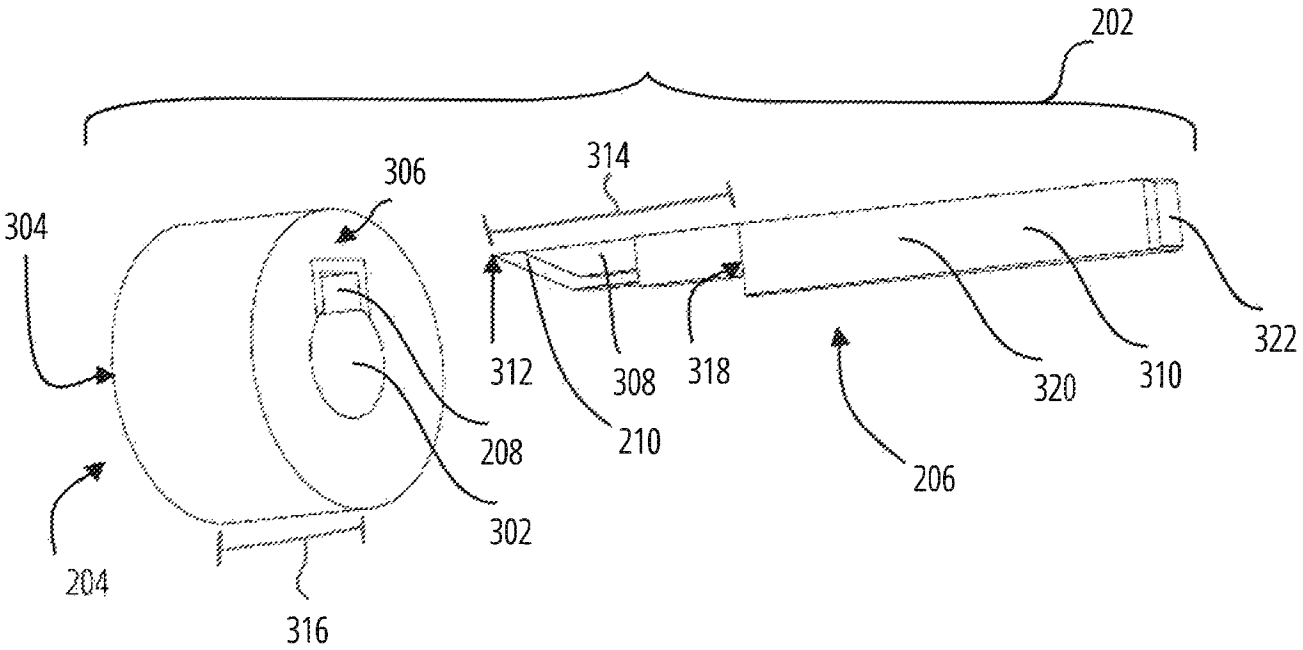
FIG. 3 is a second perspective view of the staking tool shown in FIG. 2.

FIG. 3 is a second perspective view of the staking tool 202 shown in FIG. 2. As previously described, the staking tool 202 comprises a collar 204 and a striker 206. In the exemplary embodiment, the collar 204 is substantially cylindrical in shape and includes a cylindrical aperture 302 defined through a center portion of the collar 204 from a vehicle-side face 304 to an opposing outside face 306. During use, the vehicle-side face 304 of the collar 204 faces the vehicle component 106, such as the hub assembly, while the outside face 306 faces away from the vehicle. In other words, during use the outside face 306 of the collar may face an operator using the staking tool 202. As previously described, the collar 204 also includes the guide notch 208 defined on a surface of the cylindrical aperture 302 and extending from the vehicle-side face 304 to the outside face 306. The guide notch 208 has a rectangular profile in the depicted embodiment.

In the exemplary embodiment, the striker 206 includes a shaft 308 and a handle 310. The angled tip 210 is formed on the shaft 308 at a first end 312 of the striker 206. For example, the angled tip 210 may be an integral portion of the shaft 308. Alternatively, the angled tip 210 may be coupled to the first end 312. The angled tip 210 is angled in the depicted embodiment and configured to provide an indentation of the lip portion 108 of the spindle nut 102 in a direction perpendicular to the longitudinal travel direction of the shaft 308 along the guide notch 208.

A length of the shaft 308, shown as shaft length 314, a length of the collar 204, shown as collar length 316, and the angle of the angled tip 210 determine the profile of indentation of the lip portion 108. The shaft length 314 is measured from the end of the angled tip 210, or the first end 312, to a bottom surface 318 of the handle 310. The shaft 308 will only extend through the guide notch 208 until the bottom surface 318 of the handle 310 contacts the outside face 306 of the collar 204. The shaft length 314 and collar length 316 are chosen to determine a depth of the indentation in the lip portion 108. Controlling the depth in an accurate and repeatable manner prevents damaging the lip portion 108 with a stake that is overly deep, and ensures the stake is deep enough to prevent rotation of the spindle nut 102. A steeper angle will cause the angled tip 210 to create a sharper indentation in the lip portion 108 than will a shallower angle.

The shaft 308 has a T-shaped profile in the depicted embodiment. The profile of the shaft 308 and rectangular profile of the guide notch 208 are configured to allow the shaft 308 to slide longitudinally within the guide notch 208 and maintain a radial orientation of the striker 206 with respect to the collar 204. In other words, the profile of the shaft 308 and corresponding profile of the guide notch 208 prevent the shaft 308 from rotating with respect to the guide notch 208. In other embodiments, the profile of the shaft 308 and corresponding profile of the guide notch 208 may comprise a triangle, semi-circle, or other shape configured to prevent the shaft 308 from rotating with respect to the collar 204. The specific profile of the shaft 308 in the disclosed embodiment will be discussed further with respect to FIG. 6. By preventing rotation of the shaft 308 with respect to the collar 204, the angled tip 210 strikes the lip portion 108 at a consistent angle to provide a consistent indentation.

The handle 310 includes a gripping portion 320 and a striking surface 322. The gripping portion 320 is held by the operator to position the striker 206 in the collar 204 and against the spindle nut 102; more specifically, the shaft 308 of the striker 206 within the guide notch 208, and the angled tip 210 against the lip portion 108 of the spindle nut 102. The surface of the gripping portion 320 is exposed metal in the depicted embodiment, but may include a covering to reduce vibration that may be transferred through the striker 206, and to provide added comfort to the operator operating the staking tool 202. The covering may include a wrap or a sleeve covering.

The striking surface 322 is configured to receive an impact force from an impacting tool such as the hammer 212 provided in FIG. 2. The striking surface 322 in the depicted embodiment is formed from the same material as the handle 310. However, the striking surface 322 may include a replaceable striking pad in other embodiments. The striking pad may comprise a steel, aluminum, or copper material. The striking pad may serve as a wear component of the striker 206 to extend the life of the staking tool 202. In further embodiments the striking pad may alternatively comprise a plastic material to provide more comfort to the operator utilizing the staking tool 202. The plastic material may absorb a portion of the impact force and/or reduce noise created by the impact of the hammer 212 against the striking surface 322.

Figure 4:
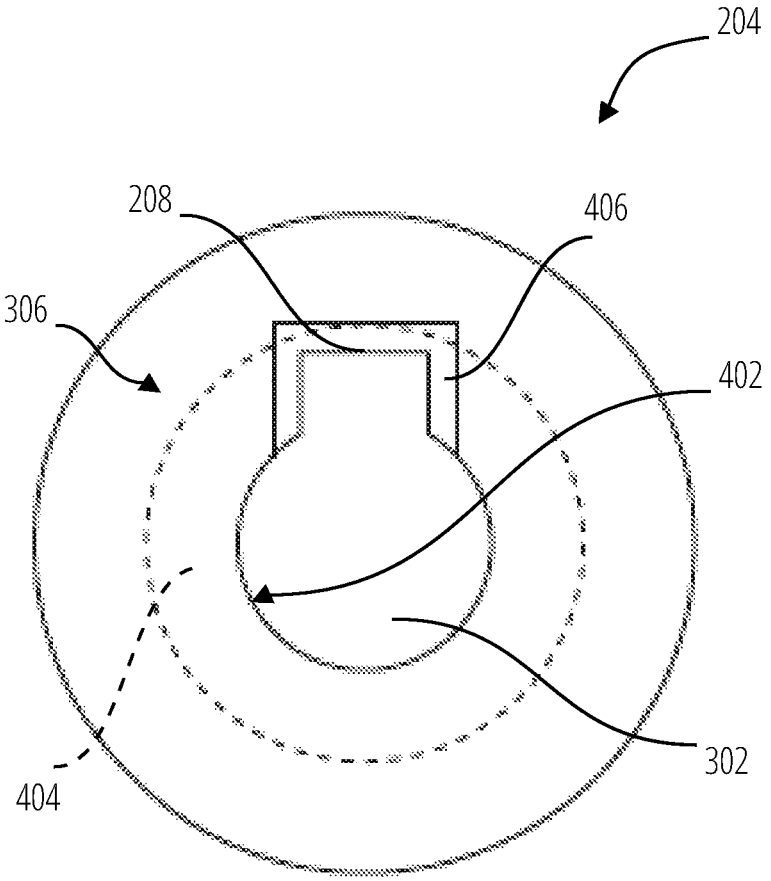
FIG. 4 is a front view of the collar shown in FIG. 2.

FIG. 4 is a front view of an exemplary embodiment a collar. The collar may be, for example, the collar 204 shown in FIGS. 2 and 3. As previously described, the collar 204 is cylindrical in shape and includes the cylindrical aperture 302 defined in a center portion and extending from the vehicle-side face 304 to the outside face 306. A surface of the cylindrical aperture 302 is shown as the interior surface 402 in FIG. 4. The guide notch 208 is defined on the interior surface 402 and comprises a substantially rectangular profile corresponding to the profile of a portion of the shaft 308 of the striker 206 and extends from the vehicle-side face 304 to the outside face 306. The cylindrical aperture 302 of the collar is configured to fit over the axle 104, and may be configured to fit over the lip portion 108 of the spindle nut 102 in alternative embodiments as described with respect to FIG. 2. A circular recess 404 is provided on the vehicle-side face 304 and configured to fit over the hex portion 112 of the spindle nut 102. It should be noted that the recess 404 is circular and not hex-shaped to allow the collar 204 to rotate around an axis of the spindle nut 102 and axle 104 to allow alignment of the guide notch 208 with the staking notch 110 of the axle 104. The collar 204 is comprised of a metallic material such as steel or aluminum.

The collar 204 may also include an insert 406 to allow for easy removal of the striker 206. Specifically, the collar may include an insert 406 portion, wherein the guide notch 208 is disposed, comprising a different material and/or surface treatment than the remainder of the collar 204. For example, the insert 406 may comprise a rolled steel material, and the remainder of the collar 204 may comprise a different type of steel material or an aluminum material. The insert 406 may be welded, pressed, glued, or coupled using other known fastening methods to the remainder of the collar 204.

The surface of the guide notch 208 may be polished or include a wear-resistant coating or surface treatment. The surface treatment of the guide notch 208 may be chosen for optimal properties related to slidability to facilitate removal of the striker 206 by the operator, and the surface treatment of the remainder of the collar 204 may be chosen for optimal properties related to wear to increase the service life of the collar 204. Similarly, in an embodiment that includes an insert 406, such as the exemplary embodiment shown, the material of the insert 406 may be chosen for optimal properties related to slidability, and the material of the remainder of the collar 204 may be chosen for optimal properties related to wear.

Figure 5:
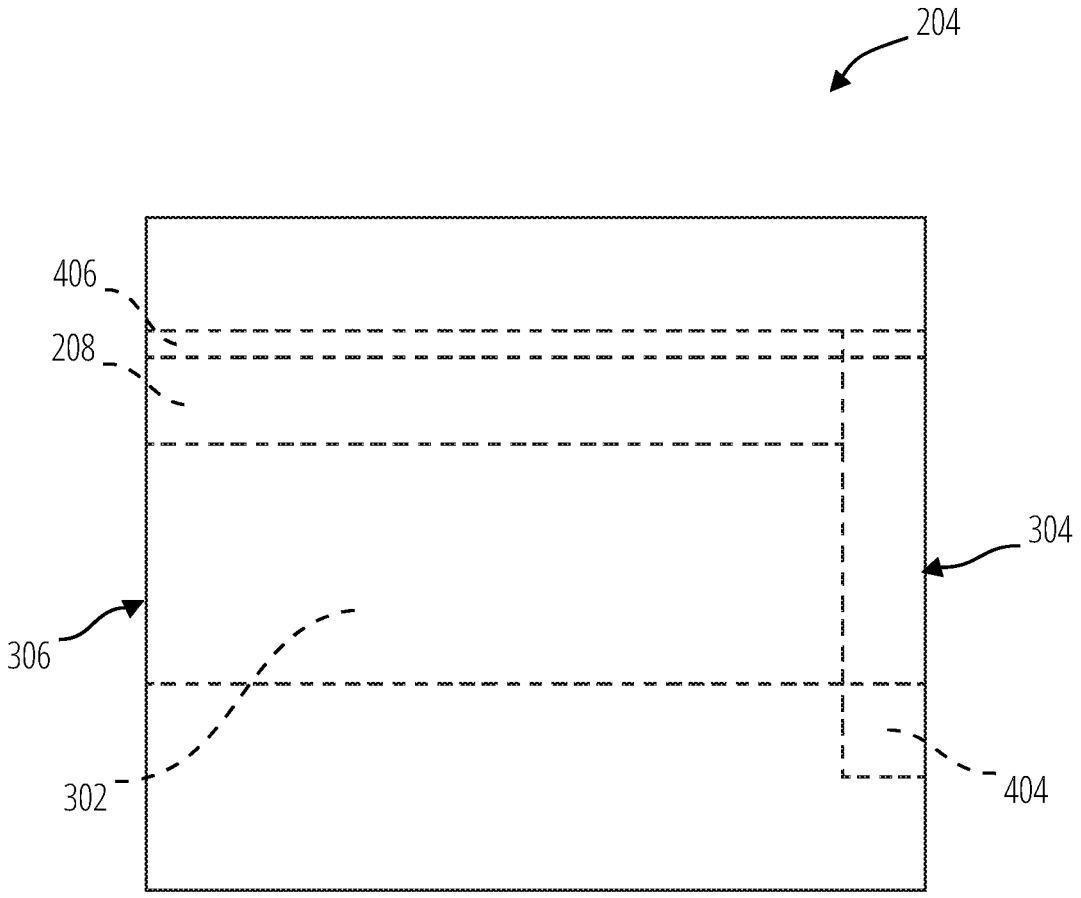
FIG. 5 is a side view of the collar shown in FIG. 2.

FIG. 5 is a side view of the collar 204. As previously described, the guide notch 208 extends from the vehicle-side face 304 to the outside face 306. The recess 404 is defined within the vehicle-side face 304 as a shallow cylindrical cut-out that is configured to accommodate the hex portion 112 of the spindle nut 102.

Figure 6:
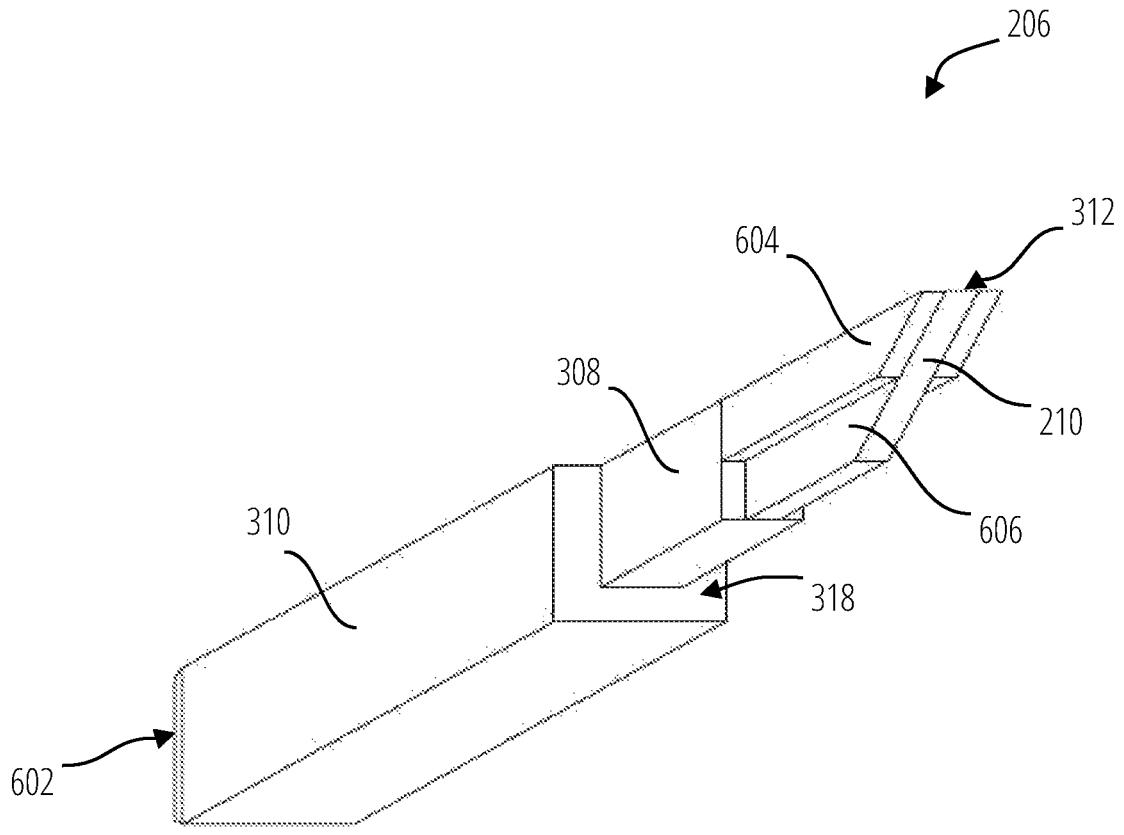
FIG. 6 is a perspective view of the striker shown in FIG. 2.

FIG. 6 is a perspective view of an exemplary embodiment of a striker. The striker may be, for example, the striker 206 shown in FIGS. 2 and 3. As previously described, the striker 206 includes the shaft 308 and the handle 310. The handle 310 includes the bottom surface 318 configured to contact the outside face 306 of the collar 204 after staking is completed. The handle 310 is disposed at a second end 602 of the striker 206. The striker 206 may be formed from a metallic material, such as steel or aluminum, a plastic material, and/or any other material that allows the striker 206 to deform the spindle nut 102 and otherwise function as described herein.

The shaft 308 further includes the angled tip 210 at the first end 312. The shaft 308 and angled tip 210 further comprise a T-shaped profile configured to indent the lip portion 108 of the spindle nut 102 into the staking notch 110. The upper part of the "T," identified as an upper profile 604 in FIG. 6, is configured to slide within the guide notch 208 of the collar 204. The lower part of the "T," identified as a lower profile 606, is configured to indent the lip portion 108. The width of the lower profile 606, along with the angle of the angled tip 210 determine the profile of the indentation created by the striker 206 on the lip portion 108. The width of the lower profile 606 and angle of the angled tip 210 are further configured to provide a consistent indent of the lip portion 108 into the staking notch 110 without cracking or otherwise damaging the lip portion 108 beyond the intended indentation. The T-shaped profile extends partially along the shaft 308 in the exemplary embodiment; however, the T-shaped profile may extend the entire length of the shaft 308 (e.g., to the bottom surface 318 of the handle 310) in other embodiments.

Figure 7:
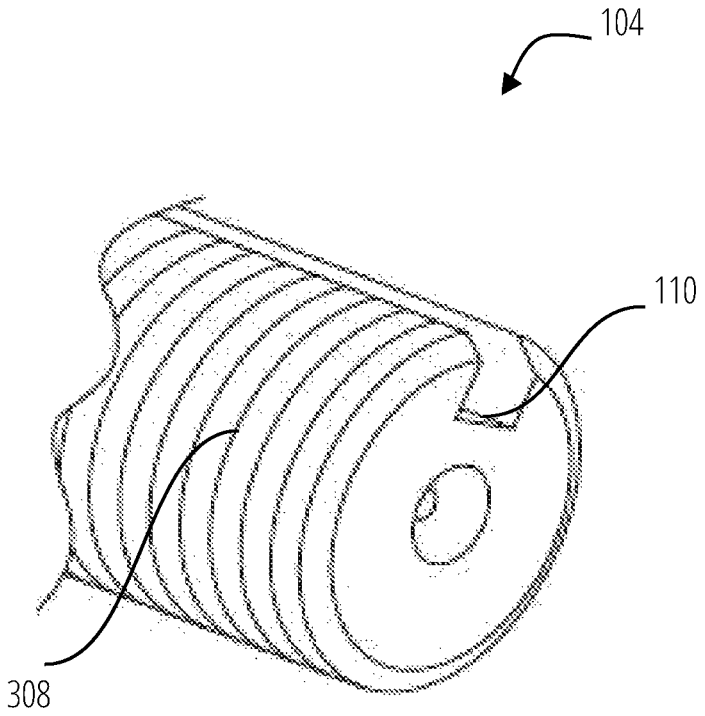
FIG. 7 is a perspective view of an exemplary embodiment of an axle.

FIG. 7 is a perspective view of an exemplary embodiment of an axle; for example, the axle 104 shown in FIG. 1. The axle 104 is a substantially rod-shaped component of the vehicle that couples to various other vehicle components such as the hub and a brake assembly. The axle 104 comprises the shaft 308 configured to receive a spindle nut, such as the spindle nut 102 provided in FIG. 1, at a threaded portion of the shaft 308. The threaded portion includes screw threads that may extend the entire length of the axle 104, or may only partially extend through the portion of the axle 104 configured to be engaged by the spindle nut 102. As previously described, the axle 104 also includes the staking notch 110 defined therein. The staking notch 110 is defined on an outer radius of the axle 104 and may extend longitudinally through the threaded portion of the shaft 308. The staking notch 110 may extend longitudinally along the axle 104 beyond the threaded portion in other embodiments wherein the threaded portion does not extend the entire length of the axle 104.

Figure 8:
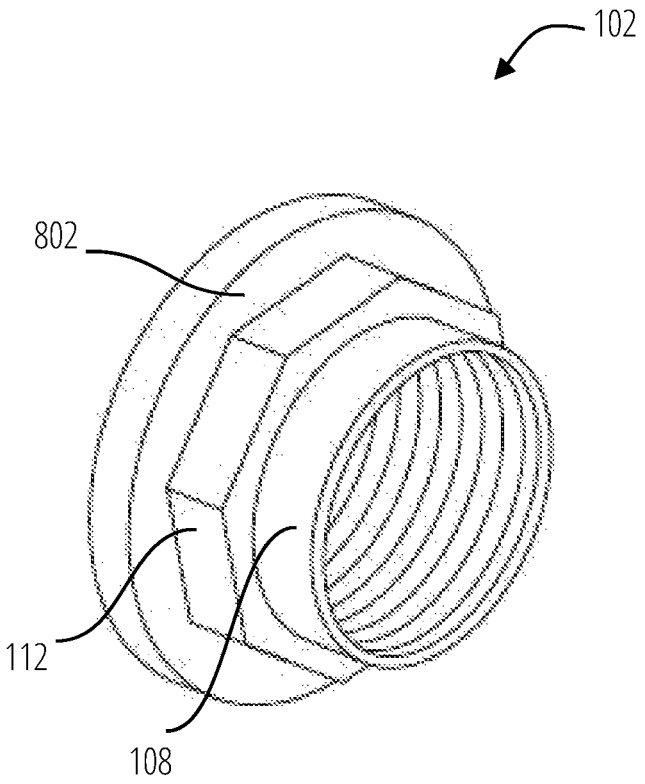
FIG. 8 is a perspective view of an exemplary embodiment of a spindle nut.

FIG. 8 is a perspective view of an exemplary embodiment of a spindle nut; for example, the spindle nut 102 shown in FIG. 1. The spindle nut 102 comprises the lip portion 108, hex portion 112, and a flange portion 802. The hex portion 112 forms a main body of the spindle nut 102, wherein the lip portion 108 and flange portion 802 are disposed on opposing surfaces of the hex portion 112. As previously described, the hex portion 112 is configured to be manipulated (e.g., rotated) by a wrench or socket. The flange portion 802 defines a vehicle-side portion of the spindle nut 102 that contacts a vehicle component when fully fastened (e.g., screwed) onto the axle 104. The lip portion 108 may have a substantially cylindrical shape; more specifically, a shape resembling a short, thin-walled, circular pipe. The lip portion 108 is configured to be indented into the staking notch of the axle 104 by the staking tool 202. Indenting the lip portion 108 into the staking notch 110 physically prevents the spindle nut 102 from unscrewing away from the vehicle component. The indentation is formed by the angled tip 210 of the staking tool 202 as described herein.

Figure 9:
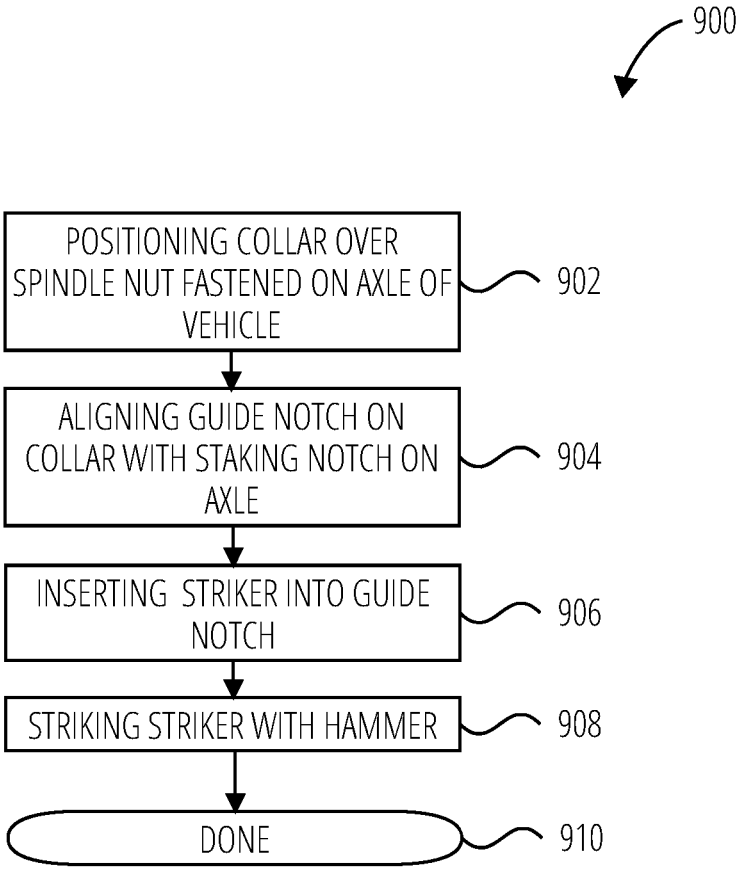
FIG. 9 is a flow chart of a method of staking a spindle nut onto an axle using a staking tool, for example, the staking tool shown in FIG. 2.

FIG. 9 is a flow chart of a method 900 of staking a spindle nut onto an axle using a staking tool, for example, the staking tool shown in FIG. 2. In an exemplary embodiment, the method 900 includes positioning 902 a collar, aligning 904 a guide notch, inserting 906 a striker, and striking 908 the striker. The collar and striker may be the collar 204 and striker 206 provided in FIG. 2.

Positioning 902 the collar 204 includes placing the collar 204 over the spindle nut 102 that is fastened on the axle 104 of a vehicle. The spindle nut 102 is configured to fit over the spindle nut 102 and allow a rotational movement of the collar 204 with respect to the spindle nut 102. In an alternative embodiment, positioning 902 the collar 204 may include verifying that a vehicle-side face 304 of the collar 204 is adjacent a flange portion 802 of the spindle nut 102 to ensure that the collar 204 is fully seated in position.

Aligning 904 the guide notch 208 includes aligning the guide notch 208 of the collar 204 with a staking notch 110 of the axle 104. The guide notch 208 is defined on an interior surface of a cylindrical aperture 302 defined in a center section of the collar 204, and the staking notch 110 is defined on an outer surface of the axle 104. In an alternative embodiment, aligning 904 the guide notch 208 may include rotating the collar 204 around the spindle nut 102 to perform the alignment of the guide notch 208 with the staking notch 110.

Inserting 906 the striker 206 includes inserting the striker 206 into the guide notch 208 on the collar 204. In an alternative embodiment, inserting 906 the striker 206 may include inserting a shaft 308 of the striker 206 into the guide notch 208 until an angled tip 210 of the shaft 308 is adjacent the spindle nut 102; more specifically, inserting the shaft 308 until the angled tip 210 contacts a lip portion 108 of the spindle nut 102.

Striking 908 the striker 206 includes impacting the striker 206 with a hammer 212 or a mallet. In an alternative embodiment, striking 908 the striker 206 includes repeatedly impacting a striking surface 322 of the handle 310 of the striker 206 until the bottom surface 318 of the handle 310 is adjacent the outside face 306 of the collar 204 (e.g., the shaft 308 of the striker 206 is fully inserted into the guide notch 208 of the collar 204). The striking surface 322 is located on an opposing end of the striker 206 as the angled tip 210. Striking 908 the striker 206 causes the angled tip 210 to form an indentation of the lip portion 108 of the collar 204 into the staking notch 110 of the axle 104 when the bottom surface 318 is adjacent the outside face 306.

The foregoing detailed description of exemplary embodiments is included for illustrative purposes only. It should be understood that other embodiments could be used, or modifications and additions could be made to the described embodiments. Therefore, the disclosure is not limited to the embodiments shown, but rather should be construed in breadth and scope in accordance with the recitations of the appended claims.

What is claimed is:

1. A staking tool for a spindle nut coupled to an axle of a vehicle, comprising:

a collar that includes a guide notch defined on an interior surface and that extends from a vehicle-side face to an opposing outside face of the collar; and a striker that includes a shaft, and an angled tip at a first end and a handle at a second end; and wherein the striker is configured to slide longitudinally within the guide notch and stake a lip portion of the spindle nut into a staking notch of the axle.

2. The staking tool of claim 1, wherein the collar includes an insert at the guide notch comprising a different material than the collar.

3. The staking tool of claim 1, wherein the guide notch has a substantially rectangular profile and the shaft has a T-shaped profile further comprising an upper profile and a lower profile; and wherein the upper profile is substantially rectangular and configured to maintain a radial orientation of the striker with respect to the collar.

4. The staking tool of claim 1, wherein the shaft is disposed at the first end of the striker and is configured to slide longitudinally within the guide notch.

5. The staking tool of claim 1, wherein the handle includes a bottom surface that is configured to limit an insertion distance of the shaft within the guide notch.

6. The staking tool of claim 1, wherein the handle includes a gripping portion and a striking surface.

7. A system for securing a hub onto a vehicle, comprising:

an axle that includes a staking notch defined on an outer surface;

a spindle nut that includes a lip portion and a hex portion;

a staking tool that includes:

a collar that includes a guide notch defined on an interior surface; and a striker that includes a handle, a shaft configured to slidingly insert into the notch, and an angled tip; and a hammer.

8. The staking tool of claim 7, wherein a shaft length and a collar length are configured to provide an insertion depth of the angled tip with respect to the lip portion wherein an indentation created by the angled tip on the lip portion prevents rotation of the spindle nut with respect to the axle.

9. The system of claim 7, wherein the collar includes a cylindrical aperture to maintain a radial orientation with respect to the lip portion of the spindle nut.

10. The system of claim 7, wherein the collar includes a circular recess to maintain a radial orientation with respect to the hex portion of the spindle nut.

11. The system of claim 7, wherein the guide notch has a substantially rectangular profile and the shaft has a T-shaped profile further comprising an upper profile and a lower profile; and wherein the upper profile is substantially rectangular and configured to maintain a radial orientation of the striker with respect to the collar.

12. The system of claim 7, wherein the angled tip is configured to deform the lip portion into the staking notch when a bottom surface of the handle is adjacent an outside face of the collar.

13. The system of claim 7, wherein the hammer is configured to strike a striking surface of the handle.

* * * * *